US008113285B2

(12) United States Patent
Williams

(10) Patent No.: US 8,113,285 B2
(45) Date of Patent: Feb. 14, 2012

(54) AGITATED WELLBORE CLEANING TOOL AND METHOD

(75) Inventor: Glynn Williams, Hants (GB)

(73) Assignee: Specialised Petroleum Services Group Limited, Aberdeen, Aberdeenshire (GB)

( * ) Notice: Subject to any disclaimer, the term of this patent is extended or adjusted under 35 U.S.C. 154(b) by 394 days.

(21) Appl. No.: 12/295,481

(22) PCT Filed: Mar. 23, 2007

(86) PCT No.: PCT/GB2007/001048

§ 371 (c)(1),
(2), (4) Date: May 13, 2009

(87) PCT Pub. No.: WO2007/113477

PCT Pub. Date: Oct. 11, 2007

(65) Prior Publication Data

US 2009/0218100 A1 Sep. 3, 2009

(30) Foreign Application Priority Data

Mar. 30, 2006 (GB) ..... 0606335.8

(51) Int. Cl.
*E21B 37/04* (2006.01)

(52) U.S. Cl. ..... 166/311; 166/173; 166/177.7

(58) Field of Classification Search ..... 166/171, 166/173, 175, 177.2, 177.7, 311, 312
See application file for complete search history.

(56) References Cited

U.S. PATENT DOCUMENTS

| | | | | |
|---|---|---|---|---|
| 4,275,795 | A * | 6/1981 | Beimgraben et al. | 175/26 |
| 4,612,986 | A | 9/1986 | Fosdick, Jr. et al. | |
| 4,799,554 | A * | 1/1989 | Clapp et al. | 166/312 |
| 5,228,508 | A | 7/1993 | Facteau et al. | |
| 5,311,955 | A | 5/1994 | Ganijew et al. | |
| 5,505,262 | A | 4/1996 | Cobb | |
| 5,819,353 | A * | 10/1998 | Armell et al. | 15/104.2 |
| 6,279,670 | B1 * | 8/2001 | Eddison et al. | 175/107 |
| 2007/0119007 | A1 * | 5/2007 | Minshall | 15/104.09 |

FOREIGN PATENT DOCUMENTS

| | | | |
|---|---|---|---|
| RU | 2 138 617 | C1 | 9/1999 |
| WO | 01/18351 | A1 | 3/2001 |
| WO | 01/81707 | A1 | 11/2001 |
| WO | 2004/013446 | A2 | 2/2004 |
| WO | 2005/093264 | A1 | 10/2005 |
| WO | WO 2006016137 | A1 * | 2/2006 |

OTHER PUBLICATIONS

International Search Report from PCT/GB2007/001048 dated 07/02/07 (4 pages).
USSR Inventor's Certificate No. 109091, dated Jan. 2, 1957 (3 pages).

* cited by examiner

*Primary Examiner* — William P Neuder
*Assistant Examiner* — Richard Alker
(74) *Attorney, Agent, or Firm* — Osha • Liang LLP

(57) ABSTRACT

A wellbore cleaning assembly is run into a wellbore to be cleaned on a work string. The cleaning assembly comprises a number of cleaning elements for cleaning a wall of the wellbore; and an oscillator coupled to the at least one cleaning element by a force transmission element, for generating an axial oscillating movement of the at least one cleaning element relative to the work string.

21 Claims, 2 Drawing Sheets

AGITATED WELLBORE CLEANING TOOL AND METHOD

FIELD OF THE DISCLOSURE

The present invention relates to a wellbore cleaning assembly, wellbore cleaning apparatus comprising a wellbore cleaning assembly, and to a method of cleaning a wellbore. In particular, but not exclusively, the present invention relates to wellbore cleaning apparatus comprising at least one cleaning element for cleaning a wall of a wellbore, to wellbore cleaning apparatus comprising such a wellbore cleaning assembly, and to a method of cleaning a wellbore using such a cleaning assembly.

BACKGROUND

In the oil and gas exploration and production industry, a wellbore or borehole of an oil or gas well is typically drilled from surface to a first depth and lined with a steel casing. The casing is located in the wellbore extending from a wellhead provided at surface or seabed level, and is then cemented in place. Following testing and other downhole procedures, the borehole is extended to a second depth and a further section of smaller diameter casing is installed and cemented in place. This process is repeated as necessary until the borehole has been extended to a location where it intersects a producing formation. Alternatively, a final section of tubing known as a liner may be located in the wellbore, extending from the lowermost casing section or casing 'shoe' to the producing formation, and is also cemented in place. The well is then completed by locating a string of production tubing extending from surface through the casing/liner to the producing formation. Well fluids are then recovered to surface through the production tubing.

However, before the well can be completed and well fluids recovered to surface, it is necessary to clean the lined wellbore and replace the fluids present in the wellbore with a completion fluid such as brine. The cleaning process serves, inter alia, to remove solids adhered to the wall of the casing or liner; to circulate residual drilling mud and other fluids out of the wellbore; and to filter out solids present in the wellbore fluid. Much of the solids present in the wellbore are found on the surface of the casing/liner, and may be rust particles and metal chips or scrapings originating from equipment used in the well and from the casing/liner itself.

Various types of cleaning tools are known, including mechanical cleaning tools which physically wipe or scrap clean the surface of the casing/liner. One type of mechanical cleaning tool is generically referred to as a casing scraper. Casing scrapers typically incorporate scraper blades designed to scrape the inner surface of the casing/liner, for removing relatively large particles of debris from the surface of the tubing. Other types of mechanical cleaning tools incorporate brushes or other abrading elements or surfaces.

Whilst these mechanical cleaning tools have been shown to be effective in cleaning a wellbore, it is generally desired to improve the cleaning action of tools of this type.

SUMMARY OF THE DISCLOSURE

It is therefore amongst the objects of at least one embodiment of the invention to provide an improved wellbore cleaning assembly.

According to a first aspect of the present invention, there is provided a wellbore cleaning assembly adapted to be run into a wellbore to be cleaned on a work string, the cleaning assembly comprising:

at least one cleaning element for cleaning a wall of the wellbore; and an oscillator coupled to the at least one cleaning element, for generating an oscillating movement of the at least one cleaning element relative to the work string.

Oscillating at least one cleaning element relative to the work string provides an enhanced cleaning action, by effectively oscillating the cleaning element relative to a wall of the wellbore during a cleaning operation, when the cleaning assembly is being translated relative to and thus along the wellbore.

It will be understood that tubing is typically located in the wellbore and thus the cleaning assembly is adapted to be run into a tubing lined wellbore for cleaning a wall of the tubing. Typically the tubing takes the form of casing and/or liner but in principle the wellbore cleaning assembly may be utilised for cleaning any downhole tubing.

Preferably, the oscillator is adapted to generate an axial oscillating movement of at least one cleaning element, relative to the work string. Accordingly, the oscillator may be adapted to axially oscillate the at least one cleaning element relative to the work string. It will therefore be understood that, in use, axial oscillation of the at least one cleaning element relative to the work string may generate a scrubbing action of the at least one cleaning element relative to a wall of the wellbore, and thus optionally up and down the wellbore wall.

The oscillator may alternatively be adapted to generate a radial oscillating movement of the at least one cleaning element, relative to the work string. Accordingly, the oscillator may be adapted to radially oscillate the at least one cleaning element relative to the work string. It will but therefore be understood that, in use, the oscillator may be adapted to oscillate the at least one cleaning element towards and away from a wall of the wellbore.

In a further alternative, the oscillator may be adapted to generate a circumferential oscillating movement of the at least one cleaning element, relative to the work string. The oscillator may therefore be adapted to circumferentially oscillate the at least one cleaning element relative to the work string.

In a still further alternative, the oscillator may be adapted to generate a plurality of oscillating movements of the at least one cleaning element, relative to the work string, the oscillating movements selected from the group comprising an axial oscillating movement; a radial oscillating movement; and a circumferential oscillating movement.

The oscillator may be fluid actuated or activated and may be a flow pulsing device. The flow pulsing device may comprise a valve adapted to vary fluid flow through a body of the device, to thereby pulse the flow of fluid through the device. The fluid pulsing device may also comprise a motor, which may be a fluid driven motor such as a positive displacement motor (PDM) or Moineau motor, the motor being coupled to the valve for actuating the valve to vary fluid flow through the body. The valve may be located in a throughbore of the device body, and may comprise a valve member which is moveable to vary the flow of fluid through the device. The valve member may be coupled to and driven by the motor and, in particular, may be coupled to a rotor of the motor.

The oscillator may be adapted to generate an oscillating movement of the at least one cleaning element relative to the workstring having a magnitude of at least 1 cm from one extreme of movement to another extreme. Preferably however, the oscillator is adapted to generate an oscillating movement of the at least one cleaning element in the range of 5 to 100 cm from one extreme to the other, relative to the workstring. It will be understood, however that the assembly may be configured to generate larger oscillations of the cleaning element.

The oscillator may be adapted to be selectively actuated during running of the cleaning assembly along a wellbore. Where the oscillator is fluid actuated, the assembly may comprise a valve arrangement for selectively directing fluid flow through the oscillator. It will therefore be understood that the valve arrangement may be utilised to selectively actuate the oscillator, and thus to selectively oscillate the at least one cleaning element. The oscillator may comprise a bypass channel, passage or the like for directing fluid flow to bypass the oscillator.

The cleaning assembly may comprise a force transmission element provided between the oscillator and the at least one cleaning element, for transmitting an oscillating force to the cleaning element. Alternatively, the cleaning element may be mounted on or provided integrally with the force transmission element. The force transmission element may take the form of a fluid actuated member and may be a piston mounted for reciprocating movement (translation) relative to a bore of the assembly, the piston transmitting an oscillating force to the cleaning element in response to applied fluid pressure. The piston may be biased towards a rest position and may be urged away from the rest position against a biasing force in response to a fluid pressure force controlled by the oscillator. The piston may be spring-biased, and a spring force of the spring may be selected such that a determined degree of movement of the at least one cleaning element relative to the work string is achieved in response to a specified fluid pressure force applied to the piston. The piston may be an annular or hollow piston defining a fluid flow passage therethrough and an annular piston face. In use of the piston, a fluid pressure force may be exerted on the piston to translate the piston relative to the bore, so that the piston is urged away from the rest position in response to applied fluid pressure.

Preferably, the cleaning assembly comprises a plurality of cleaning elements. The at least one cleaning element may be selected from a group comprising a scraper, wiper, brush, bristle or any other suitable mechanical/abrading element. Where a plurality of cleaning elements are provided, the cleaning assembly may comprise at least two different types of cleaning element selected from the above group.

Preferably also, the cleaning assembly comprises a cleaning device, the cleaning device carrying the at least one cleaning element. The cleaning device may be any one of the mechanical wellbore cleaning devices commercially available from the applicant. The cleaning assembly may comprise a plurality of cleaning devices, each cleaning device including at least one cleaning element. Accordingly, a single oscillator may be utilised for oscillating the cleaning elements of two or more cleaning devices.

The oscillator may be provided as a separate device coupled to the cleaning device. The cleaning device may be coupled to the oscillator such that the entire cleaning device is oscillated. Alternatively, the at least one cleaning element may be mounted for movement relative to a body of the cleaning device, such that the body is stationary relative to the workstring and only the at least one cleaning element is oscillated.

In an alternative, the at least one cleaning element may be provided together with the oscillator. For example, the cleaning element may be moveably mounted relative to a body housing the oscillator.

According to a second aspect of the present invention, there is provided wellbore cleaning apparatus comprising:

a work string;

a wellbore cleaning assembly coupled to the work string, the cleaning assembly comprising at least one cleaning element for cleaning a wall of a wellbore and an oscillator coupled to the at least one cleaning element, for generating an oscillating movement of the at least one cleaning element relative to the work string.

Further features of the wellbore cleaning assembly of the second aspect of the invention are defined above in relation to the first aspect.

According to a third aspect of the present invention, there is provided a method of cleaning a wellbore, the method comprising the steps of:

mounting a wellbore cleaning assembly on a work string;

running the wellbore cleaning assembly into a wellbore to be cleaned on the work string such that an at least one cleaning element of the cleaning assembly cleans a wall of the wellbore;

activating an oscillator coupled to the at least one cleaning element, to oscillate the at least one cleaning element relative to the work string, to thereby enhance the cleaning action of the at least one cleaning element.

The method may comprise translating the cleaning assembly relative to the wellbore wall, and oscillating the at least one cleaning element relative to the work string, to clean the wellbore wall.

The oscillator may generate an axial oscillating movement of at least one cleaning element, relative to the work string. Accordingly, the oscillator may axially oscillate the at least one cleaning element relative to the work string. The at least one cleaning element may be actuated by the oscillator to clean the wellbore wall in a scrubbing action, optionally up and down the wellbore wall.

The oscillator may alternatively generate a radial oscillating movement of the at least one cleaning element, relative to the work string. Accordingly, the oscillator may be radially oscillate the at least one cleaning element relative to the work string. It will but therefore be understood that, in use, the oscillator may oscillate the at least one cleaning element towards and away from a wall of the wellbore.

In a further alternative, the oscillator may generate a circumferential oscillating movement of the at least one cleaning element, relative to the work string. The oscillator may therefore circumferentially oscillate the at least one cleaning element relative to the work string.

In a still further alternative, the oscillator may generate a plurality of oscillating movements of the at least one cleaning element, relative to the work string, the oscillating movements selected from the group comprising an axial oscillating movement; a radial oscillating movement; and a circumferential oscillating movement.

The method may comprise actuating the oscillator by pumping fluid through the oscillator. The method may comprise generating a pulsing fluid flow. To achieve this, an oscillator in the form of a flow pulsing device may be provided, and the method may comprise actuating a valve of the device to vary fluid flow through a body of the device, to thereby pulse the flow of fluid. The method may comprise actuating and thus driving the valve using a fluid driven motor, and may comprise coupling the motor to the valve for actuating the valve to vary fluid flow through the body. The motor may be actuated to rotate a valve member of the valve which is coupled to the motor and, in particular, which is coupled to a rotor of the motor.

The oscillator may generate an oscillating movement of the at least one cleaning element relative to the workstring having a magnitude of at least 1 cm from one extreme of movement to another extreme. Preferably however, the oscillator generates an oscillating movement of the at least one cleaning element in the range of 5 to 100 cm from one extreme to the other, relative to the workstring. It will be understood, however that the assembly may be configured to generate larger oscillations of the cleaning element.

The oscillator may be selectively actuated during running of the cleaning assembly along a wellbore. Where the oscillator is fluid actuated, the fluid may be selectively directed through the oscillator. It will therefore be understood that a valve arrangement may be provided and may be utilised to selectively actuate the oscillator, and thus to selectively oscillate the at least one cleaning element.

An oscillating force generated by the oscillator may be transmitted to the at least one cleaning element by a force transmission element provided between the oscillator and the at least one cleaning element. Alternatively, the oscillator may be mounted on or provided integrally with the force transmission element.

The method may comprise providing a plurality of cleaning devices, each cleaning device having at least one cleaning element, the each cleaning device driven by and thus oscillated by a single oscillator. It will be understood, however, that an oscillator may be provided for each cleaning device/element.

The cleaning element may be provided on a cleaning device, and the oscillator may oscillate the entire cleaning device. Alternatively, the at least one cleaning element may be mounted for movement relative to a body of the cleaning device, such that the body is stationary relative to the workstring, and the oscillator may only oscillate the at least one cleaning element relative to the workstring.

BRIEF DESCRIPTION OF THE DRAWINGS

An embodiment of the present invention will now be described, by way of example only, with reference to the accompanying drawings, in which.

DETAILED DESCRIPTION

Figure 1:
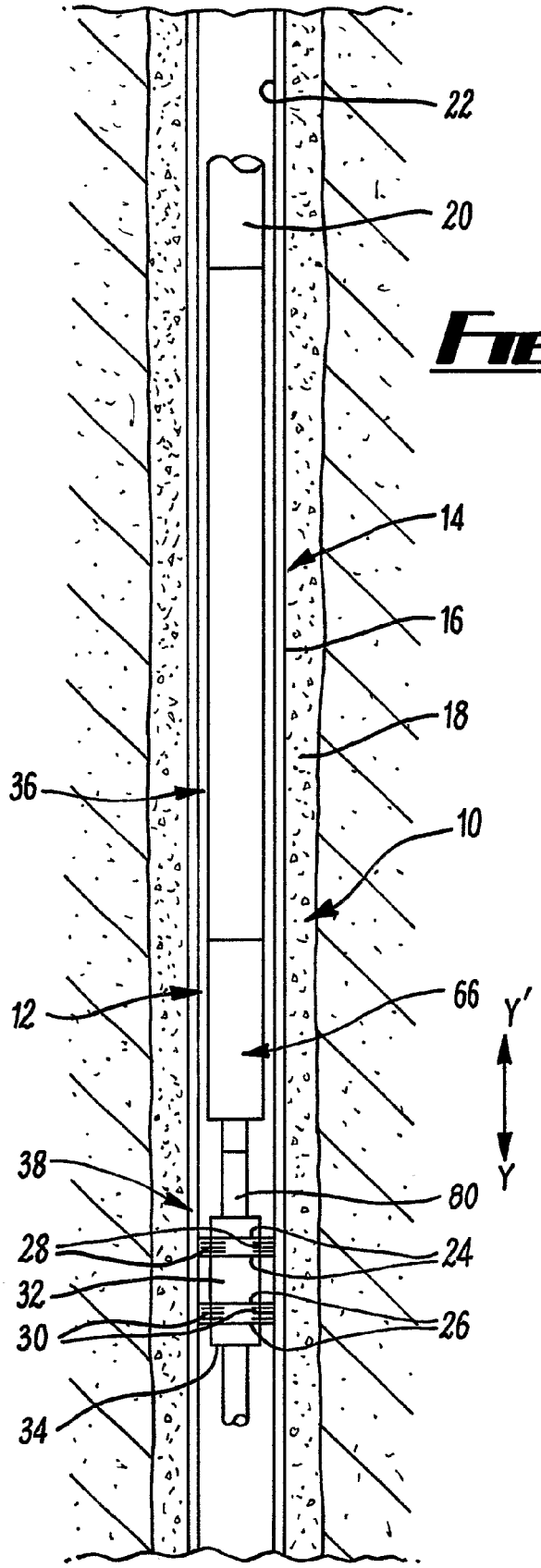
FIG. 1 is a longitudinal, partial cross-sectional view of wellbore cleaning apparatus, comprising a wellbore cleaning assembly, in accordance with an embodiment of the present invention, the apparatus shown during the cleaning of a wellbore.

Turning firstly to FIG. 1, there is shown a longitudinal partial sectional view of wellbore cleaning apparatus indicated generally by reference numeral 10, the cleaning apparatus 10 including a wellbore cleaning assembly 12, in accordance with an embodiment of the present invention. The wellbore cleaning apparatus 10 is shown in FIG. 1 during the cleaning of a wellbore 14 which has been lined with a metal casing 16 and cemented at 18, in a fashion known in the art.

The cleaning apparatus 10 comprises a work string 20 on which the wellbore cleaning assembly 12 is mounted and by which the assembly 12 is run into and along the wellbore 14, for cleaning an inner wall 22 of the casing 16. As will be appreciated by persons skilled in the art, the workstring 20 may be formed from lengths of tubing coupled together end-to-end, or may be coiled tubing.

The cleaning assembly 12 comprises at least one cleaning element for cleaning the casing inner wall 22 and, in the illustrated embodiment, the cleaning assembly 12 comprises a number of cleaning elements in the form of casing wipers 24, 26 and a number of bristle packs 28, 30 which are arrange circumferentially around an outer surface 32 of a body 34.

The cleaning assembly 12 also comprises an oscillator in the form of a flow pulsing device 36 which is coupled to the wipers 24, 26 and the bristle packs 28, 30 for generating an oscillating movement of the wipers and bristle packs relative to the workstring 20.

The casing wipers 24, 26 and bristle packs 28, 30 are in fact provided as part of a cleaning device 38 which, in the illustrated embodiment, takes the form of the applicant's commercially available BRISTLE BACK® RISER BRUSH TOOL. However, as will be appreciated by persons skilled in the art, many different types of mechanical cleaning devices, optionally including alternative types of cleaning elements such as scrapers or brushes, may be utilised.

As will be described in more detail below, the cleaning action of the casing wipers 24, 26 and the bristle packs 28, 30 is enhanced by oscillation of the wipers and packs using the flow pulsing device 36. The flow pulsing device 36, when actuated, axially oscillates the casing wipers 24, 26 and the bristle packs 28, 30 in the direction of the arrows Y-Y', relative to the workstring 20. This movement of the wipers 24, 26 and bristle packs 28, 30 enhances the cleaning action on the casing wall 22 during passage of the cleaning apparatus 10 through the wellbore 14, by imparting a scrubbing action on the casing wall.

In use, the wellbore cleaning assembly 12 is made up at surface and coupled to a section of workstring tubing which will form the lowermost end of the workstring 20. The cleaning apparatus 10 is then run into the wellbore casing 16, and successive lengths of workstring tubing are connected together end-to-end to form the completed string, in a fashion known in the art. The flow pulsing device 36 is activated to generate an oscillating movement, which is transmitted to the wipers 24, 26 and bristle packs 28, 30. The cleaning assembly 12 is then translated downhole relative to the casing 16 such that the wipers 24, 26 and bristle packs 28, 30 together clean the casing wall 22 with an enhanced cleaning action due to oscillation of the cleaning elements. Debris particles dislodged from the casing inner wall 22 may be collected by a junk basket or the like provided as part of the cleaning apparatus 10. The flow pulsing device 36 remains activated during pull-out of the cleaning assembly 12, to further clean the casing wall 22 on return to surface. Any remaining debris is then flushed out by circulating a completion fluid into the borehole 14.

The flow pulsing device 36 will now be described in more detail with reference to the enlarged, partial longitudinal sectional view of FIG. 2 and the longitudinal sectional view of FIG. 3.

Figure 2:
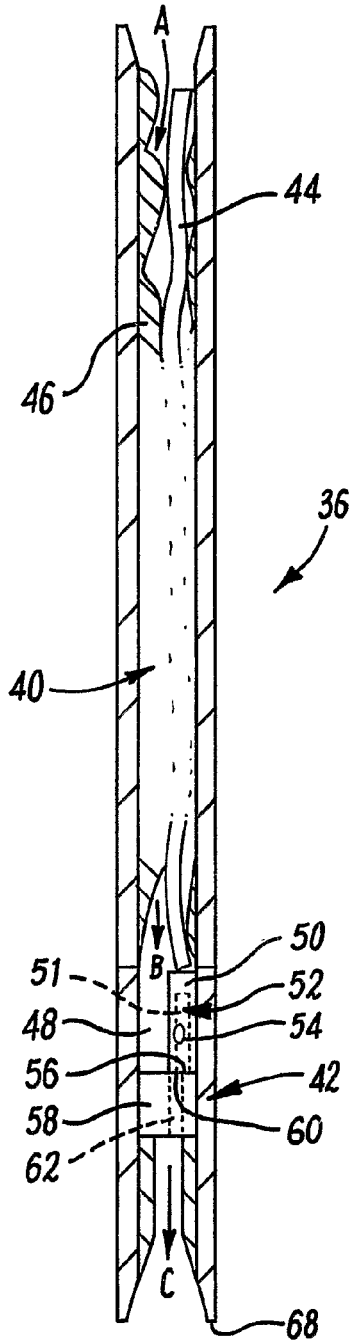
FIG. 2 is an enlarged, partial longitudinal sectional view of an oscillator which forms part of the cleaning assembly shown in FIG. 1.

As shown in FIG. 2, the flow pulsing device 36 includes a motor in the form of a positive displacement motor (PDM) 40 and a valve generally indicated by reference numeral 42. The PDM 40 is of a type known in the art and includes a rotor 44 and a stator 46. The rotor 44 is driven and rotated by fluid flowing down through cavities defined between the rotor 44 and the stator 46 in the direction of the arrow A, the fluid exiting a lower end of the stator 46 as shown by the arrow B. The valve 42 is mounted in a bore 48 of the device 36 and includes a rotatable valve member 50. The valve member 50 defines a section 51 of an internal flow passage 52 and has a number of openings, one of which is shown and given the reference numeral 54. The openings 54 each extend between the bore 48 and the internal flow passage section 51.

The valve member 50 is coupled to and rotatably driven by the rotor 44 and follows an eccentric path around the bore 48. A lower end of the flow passage section 51 forms an outlet 56 and, in use, fluid flowing into the device bore 48 enters the openings 54, flows into the internal flow passage 52 and out of the valve member 50 through the outlet 56. The fluid then flows into a body 58 through an inlet 60 and along section 62 of the flow passage, exiting the valve 42 in the direction of the arrow C.

In use, rotation of the valve member 50 by the rotor 44 causes a variation in the flow area 52 defined between the valve member 50 and the body 58, which extends across the outlet 56 and inlet 60. As a result, pressure fluctuations are generated in the fluid flowing through the valve 42, which are utilised to generate an oscillating movement of the wipers 24, 26 and bristle packs 28, 30 by oscillating the cleaning device 38, as will now be described with reference to FIG. 3.

Figure 3:
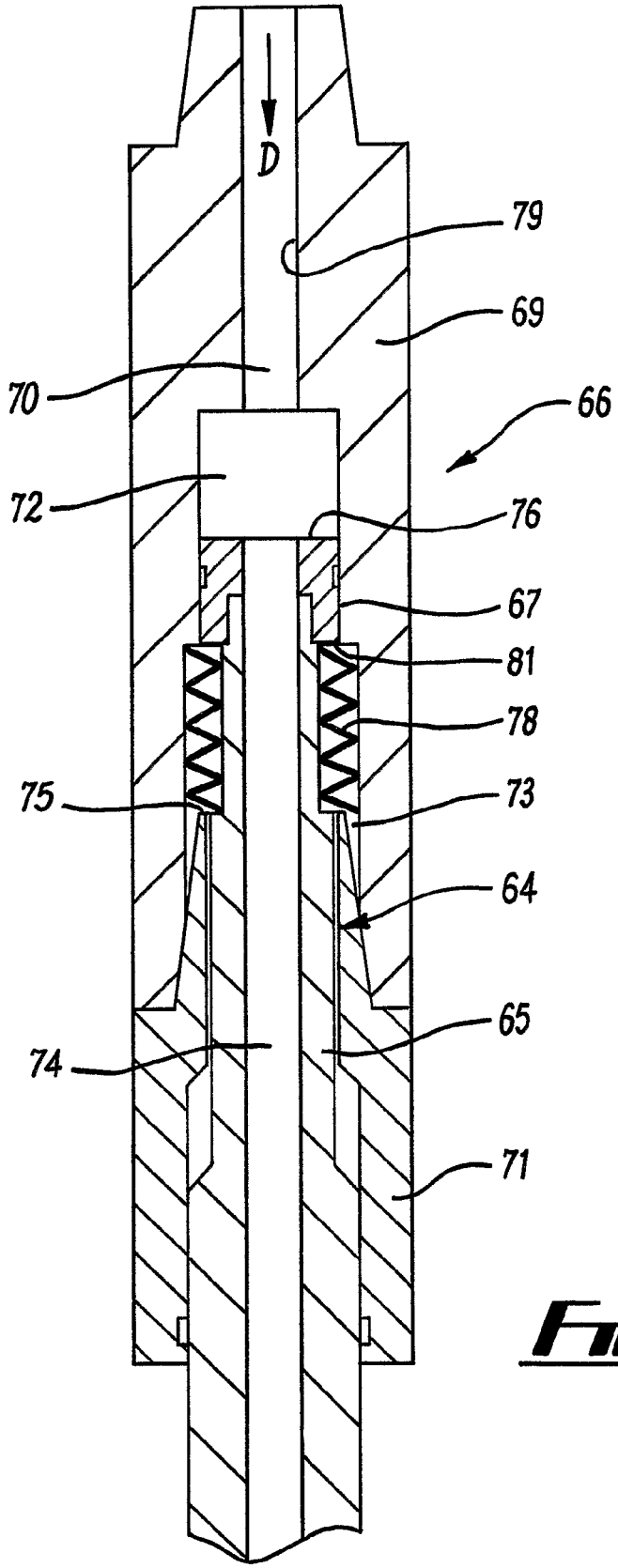
FIG. 3 is a longitudinal sectional view of a force transmission element, forming part of the assembly of FIG. 1.

Accordingly, turning to FIG. 3, a force transmission element in the form of a piston 64 is shown, provided within a shock sub 66. The piston 64 comprises a mandrel 65 and a piston head 67 threaded onto an upper end of the mandrel. The shock sub 66 is coupled to a lower end 68 of the PDM 40 (FIG. 2), and fluid exiting the valve 42 in the direction of the arrow C flows into an internal bore 70 of the shock sub 66. The shock sub 66 includes an upper body 69, and a lower body 71 which is threaded to the upper body 69, and which extends into a chamber 73 between the upper body 69 and the mandrel 65, and defines a shoulder 75. The piston mandrel 65 is hollow, defining an inner bore 74, and is mounted for movement within a section 72 of the bore 70. The piston head 67 defines an upper piston face 76, and Belleville washers 78 are located in the chamber 73 between the piston head 67 and the shoulder 75 of the sub lower body 71.

In use, fluid entering the enlarged lower section 72 of the bore 70 exerts a fluid pressure force on the piston face 76, due to the differential area of the enlarged lower section 72 relative to an upper section 79 of the bore 70. As a result, the piston head 67 is urged downwardly, against the biasing force of the Belleville washers 78, which are compressed between a lower face 81 of the piston head 67 and the shoulder 75.

On rotation of the valve member 50, causing a reduction in the flow passage area and thus a decrease in the fluid pressure entering the shock sub 66, the Belleville washers 78 act on the piston head 65 to return the piston 64 upwardly. It will therefore be understood that the piston 64 is oscillated back and forth in the direction of the arrows Y-Y' (FIG. 1), dependent upon the pressure of fluid entering the shock sub 66. The frequency of these oscillations is controlled by the frequency of rotation of the valve member 50, which is ultimately dependent upon the frequency of rotation of the rotor 44, and thus of the fluid flow rate through the PDM 40.

The piston 64 is connected to a mandrel 80 of the cleaning device 38 and thus the oscillating movement of the piston 64 is transmitted to the cleaning device 38, to oscillate the wipers 24, 26 and bristle packs 28, 30 as described above. The extent of axial oscillation of the wipers 24, 26 and bristle packs 28, 30 relative to the work string 20 is governed by a number of factors including the dimensions of the piston 64, shock sub 66 and Belleville washers 78; the inherent spring force of the Belleville washers 78; and the fluid pressure force acting on the piston 64 (and thus the pressure of fluid passing down through the PDM 40 into the shock sub 66). Typical oscillations of the wipers 24, 26 and bristle packs 28, 30 relative to the work string 20 will be of the order of several cm from one extreme or extent of motion to the other. However, appropriate dimensioning and pressure control will enable a wide range of oscillation amplitudes to be provided.

Various modifications may be made to the foregoing without departing from the spirit and scope of the present invention.

For example, it will be readily understood by persons skilled in the art that alternative oscillator structures may be provided. To achieve this, different structures or types of downhole motor may be provided, and different structures and arrangements of valves.

The oscillator may be alternatively adapted to generate a radial oscillating movement of the at least one cleaning element, relative to the work string. Accordingly, the oscillator may be adapted to radially oscillate the at least one cleaning element relative to the work string. Thus, in use, the oscillator may be adapted to oscillate the at least one cleaning element towards and away from a wall of the wellbore.

This may be achieved by mounting the wipers 24, 26 and/or bristle packs 28, 30 on inclined ramps. In this fashion, frictional contact between the wipers 24, 26 and/or bristle packs 28, 30 and the casing wall 22, combined with an oscillating movement of the cleaning tool body 34, progressively axially advances and retracts the wipers 24, 26 and/or bristle packs 28, 30 along the ramps, radially oscillating them towards and away from the casing wall 22.

In a variation, the wipers 24, 26 and/or bristle packs 28, 30 may be mounted on pads which are radially movable relative to a body of a cleaning tool, the pads forming pistons which are effectively oscillated by variations in fluid pressure through the tool bore. Alternatively, a mandrel having an angled ramp is mounted in the tool bore, and is oscillated up and down against a biasing spring, by variations in fluid pressure, to urge the pads in and out. The mandrel may carry keys that engage in channels in the pads, to actively carry the pads in and out when the mandrel is cycled up and down. In both cases, the pads could be initially held by shear pins to ensure that they are not released until a predetermined pressure is applied.

In a further alternative, the oscillator may be adapted to generate a circumferential oscillating movement of the at least one cleaning element, relative to the work string. The oscillator may therefore be adapted to circumferentially oscillate the at least one cleaning element relative to the work string. This may be achieved by providing a cam arrangement between the piston 64 and the shock sub upper body 69, such that axial movement between the piston 64 and the upper body 69 also rotates the piston within the body 69. Accordingly, repeated axial oscillation of the piston 64 within the upper body 69 may also rotate the piston.

In a variation, circumferential oscillation may be achieved by mounting the wipers 24, 26 and/or bristle packs 28, 30 on a sleeve around a body of the tool. An indexing channel and indexing pin arrangement may be provided between the sleeve and a mandrel in the tool bore. Indexing pins/dogs engage in the indexing channel, and cycling the mandrel up and down rotates the sleeve back and forth within the wellbore.

In a still further alternative, the oscillator may be adapted to generate a plurality of oscillating movements of the at least one cleaning element, relative to the work string, the oscillating movements selected from the group comprising an axial oscillating movement; a radial oscillating movement; and a circumferential oscillating movement. This may be achieved by providing a cleaning tool combining one of more of the above features.

Where the oscillator is fluid actuated, the assembly may comprise a valve arrangement for selectively directing fluid flow through the oscillator. The valve arrangement may be utilised to selectively actuate the oscillator, and thus to selectively oscillate the at least one cleaning element. The oscillator may comprise a bypass channel, passage or the like for directing fluid flow to bypass the oscillator.

The at least one cleaning element may be mounted on or provided integrally with the force transmission element. Alternatively, the at least one cleaning element may be mounted for movement relative to a body of the cleaning device, such that the body is stationary relative to the workstring and only the at least one cleaning element is oscillated. Alternatively, the at least one cleaning element may be provided together with the oscillator. For example, the cleaning element may be moveably mounted relative to a body housing the oscillator.

The invention claimed is:

1. A wellbore cleaning assembly adapted to be run into a wellbore to be cleaned on a work string, the cleaning assembly comprising:

at least one cleaning element for cleaning a wall of the wellbore; and an oscillator, wherein the cleaning assembly comprises a force transmission element provided between the oscillator and the at least one cleaning element for transmitting an oscillating force to the cleaning element, such that the oscillator is coupled to the at least one cleaning element for generating an axial oscillating movement of the at least one cleaning element relative to the work string, and the oscillator is a fluid actuated, flow pulsing device comprising a valve and a body, the valve being configured to vary fluid flow through the body of the device, to thereby pulse the flow of fluid through the device.

2. The assembly as claimed in claim 1, wherein the oscillator is adapted to generate a plurality of oscillating movements of the at least one cleaning element, relative to the work string.

3. The assembly as claimed in claim 1, wherein the flow pulsing device comprises a fluid driven motor coupled to the valve for actuating the valve to vary fluid flow through the body.

4. The assembly as claimed in claim 1, wherein the valve is located in a throughbore of the device body, and comprises a valve member which is moveable to vary the flow of fluid through the device.

5. The assembly as claimed in claim 4, wherein the valve member is coupled to and driven by a rotor of the motor.

6. The assembly as claimed in claim 1, wherein the oscillator is adapted to generate an oscillating movement of the at least one cleaning element relative to the workstring, the oscillating movement having a magnitude of at least 1 cm from one extreme of movement to another extreme.

7. The assembly as claimed in claim 6, wherein the oscillator is adapted to generate an oscillating movement of the at least one cleaning element in the range of 5 to 100 cm from one extreme of movement to the other.

8. The assembly as claimed in claim 1, wherein the oscillator is adapted to be selectively actuated during running of the cleaning assembly into and along a wellbore.

9. The assembly as claimed in claim 1, wherein the force transmission element takes the form of a fluid actuated piston mounted for reciprocating movement relative to a bore of the assembly, the piston transmitting an oscillating force to the cleaning element in response to applied fluid pressure.

10. The assembly as claimed in claim 9, wherein the piston is biased towards a rest position and adapted to be urged away from the rest position against a biasing force in response to an applied fluid pressure force.

11. The assembly as claimed in claim 10, wherein the piston is spring-biased, and a spring force of the spring is selected such that a determined degree of movement of the at least one cleaning element relative to the work string is achieved in response to a specified fluid pressure force applied to the piston.

12. The assembly as claimed in claim 10, wherein the piston is a hollow piston defining a fluid flow passage therethrough and an annular piston face and wherein, in use, a fluid pressure force is exerted on the piston to translate the piston relative to the bore, such that the piston is urged away from the rest position in response to applied fluid pressure.

13. The assembly as claimed in claim 1, further comprising a plurality of cleaning devices, each cleaning device carrying an at least one cleaning element, and wherein the oscillator is adapted to oscillate the cleaning elements of each cleaning device simultaneously.

14. A method of cleaning a wellbore, the method comprising:

providing a wellbore cleaning assembly comprising at least one cleaning element, an oscillator, and a force transmission element provided between the oscillator and the at least one cleaning element, the oscillator being a fluid actuated, flow pulsing device comprising a valve and a body, said valve being configured to vary fluid flow through the body of the device, to thereby pulse the flow of fluid through the device;

mounting the wellbore cleaning assembly on a work string;

running the wellbore cleaning assembly into a wellbore to be cleaned on the work string such that the at least one cleaning element of the cleaning assembly cleans a wall of the wellbore;

activating the oscillator by pumping fluid through the oscillator to thereby cause the force transmission element to transmit an axial oscillating force to the cleaning element; and oscillating the at least one cleaning element relative to the work string to thereby enhance the cleaning action of the at least one cleaning element.

15. The method claimed in claim 14, further comprising translating the cleaning assembly relative to the wellbore wall, and oscillating the at least one cleaning element relative to the work string, to clean the wellbore wall.

16. The method claimed in claim 14, wherein the oscillator generates an axial oscillating movement of at least one cleaning element, relative to the work string.

17. The method claimed in claim 16, wherein the at least one cleaning element is actuated by the oscillator to clean the wellbore wall in a scrubbing action up and down the wellbore wall.

18. The method claimed in claim 14, wherein the oscillator generates a plurality of oscillating movements of the at least one cleaning element, relative to the work string.

19. The method claimed in claim 14, further comprising selectively actuating the oscillator during running of the cleaning assembly along a wellbore.

20. The method claimed in claim 14, further comprising oscillating a plurality of cleaning devices, each cleaning device having an at least one cleaning element, using a single oscillator.

21. The method claimed in claim 14, wherein oscillation of the at least one cleaning element by said oscillator is independent of any incidental oscillation arising from normal rotation or reciprocation of the work string.

* * * * *